US008764179B2

(12) United States Patent
Roof et al.

(10) Patent No.: US 8,764,179 B2
(45) Date of Patent: Jul. 1, 2014

(54) METHODS FOR RADIATION CURABLE GEL INK LEVELING AND DIRECT-TO-SUBSTRATE DIGITAL RADIATION CURABLE GEL INK PRINTING, APPARATUS AND SYSTEMS HAVING PRESSURE MEMBER WITH HYDROPHOBIC SURFACE

(75) Inventors: Bryan J. Roof, Newark, NY (US); Anthony S. Condello, Webster, NY (US); Santokh Badesha, Pittsford, NY (US); David J. Gervasi, Pittsford, NY (US)

(73) Assignee: Xerox Corporation, Norwalk, CT (US)

( * ) Notice: Subject to any disclaimer, the term of this patent is extended or adjusted under 35 U.S.C. 154(b) by 46 days.

(21) Appl. No.: 13/179,063

(22) Filed: Jul. 8, 2011

(65) Prior Publication Data

US 2013/0010041 A1 Jan. 10, 2013

(51) Int. Cl.
*B41J 2/01* (2006.01)

(52) U.S. Cl.
USPC ..... 347/102; 347/103; 347/104

(58) Field of Classification Search
USPC ..... 347/102, 105, 103, 104; 399/333, 324; 428/375
See application file for complete search history.

(56) References Cited

U.S. PATENT DOCUMENTS

| | | | | |
|---|---|---|---|---|
| 5,649,481 | A | 7/1997 | Müller et al. | |
| 7,419,257 | B2 | 9/2008 | Mouri et al. | |
| 8,136,936 | B2 | 3/2012 | Hook et al. | |
| 8,231,214 | B2 | 7/2012 | Roof et al. | |
| 8,240,808 | B2 | 8/2012 | Sasayama | |
| 8,334,026 | B2 | 12/2012 | Chretien et al. | |
| 2002/0027587 | A1 | 3/2002 | Sugaya et al. | |
| 2003/0205059 | A1 | 11/2003 | Roche et al. | |
| 2005/0190248 | A1* | 9/2005 | Konno et al. | 347/102 |
| 2005/0212884 | A1* | 9/2005 | Ueki et al. | 347/105 |
| 2006/0210902 | A1* | 9/2006 | Nakamura et al. | 430/108.4 |
| 2007/0048038 | A1* | 3/2007 | Koido | 399/324 |
| 2009/0226228 | A1* | 9/2009 | De Jong et al. | 399/333 |
| 2010/0101717 | A1* | 4/2010 | Roof | 156/250 |
| 2010/0103235 | A1* | 4/2010 | Roof et al. | 347/102 |
| 2010/0141720 | A1* | 6/2010 | Ready et al. | 347/88 |
| 2010/0151245 | A1* | 6/2010 | Law et al. | 428/375 |

* cited by examiner

*Primary Examiner* — Manish S Shah
*Assistant Examiner* — Yaovi Ameh
(74) *Attorney, Agent, or Firm* — Ronald E. Prass, Jr.; Prass LLP

(57) ABSTRACT

A UV curable gel ink leveling method for digital direct-to-substrate UV curable gel ink printing includes jetting UV curable gel ink directly onto a substrate, irradiating the gel ink to increase a viscosity of the gel ink, adding sacrificial release fluid to a hydrophilic contact roll, and leveling the ink at a leveling nip formed by the contact roll and a pressure roll. The pressure roll comprises an elastomeric material and a surface that is hydrophobic.

12 Claims, 3 Drawing Sheets

METHODS FOR RADIATION CURABLE GEL INK LEVELING AND DIRECT-TO-SUBSTRATE DIGITAL RADIATION CURABLE GEL INK PRINTING, APPARATUS AND SYSTEMS HAVING PRESSURE MEMBER WITH HYDROPHOBIC SURFACE

RELATED APPLICATIONS

This application is related to U.S. patent application METHODS FOR UV GEL INK LEVELING AND DIRECT-TO-SUBSTRATE DIGITAL RADIATION CURABLE GEL INK PRINTING, APPARATUS AND SYSTEMS HAVING LEVELING MEMBER WITH A METAL OXIDE SURFACE Ser. No. 13/173,492, the disclosure of which is incorporated herein by reference in its entirety.

FIELD OF DISCLOSURE

The disclosure relates to methods, apparatus, and systems for radiation curable gel ink leveling. In particular, the disclosure relates to methods, apparatus, and systems for contact leveling radiation curable gel ink using a pressure roll having a hydrophobic surface.

BACKGROUND

Radiation curable gel inks, e.g., UV curable gel inks, tend to form drops having less mobility than those formed by conventional inks when jetted directly onto a substrate. When UV gel inks are jetted from a print head to be deposited directly onto a substrate to form an image, the ink drops are liquid. When the drops contact the substrate, they are quickly quenched to a gel state, and therefore have limited mobility.

Conventional inks tend to form mobile liquid drops upon contact with a substrate. To prevent coalescence of the mobile liquid ink drops during printing, substrates are typically coated and/or treated. For example, a paper substrate for use with conventional inks may be coated with materials that increase adhesion characteristics and increase surface energy, or otherwise affect chemical interaction between the paper substrate and inks. Such coatings or treatments require special operations to apply to the media, and additional cost is associated with their use in printing operations. For example, a printing process using both digital presses and conventional presses may require different media supplies suitable for each press.

Radiation curable gel inks are advantageous for printing operations at least because they exhibit superior drop positioning on a variety of substrate types, regardless of how the substrates are treated. It is cost advantageous, for example, to run the same media or substrate type across multiple printing apparatuses and not to have to carry, for example, specially coated stock.

SUMMARY

Radiation curable gel ink print heads typically leave a noticeable signature of the printing process, which may include jetted ink lines having a center that is thicker than outer edges of the ink line. For example, UV gel ink images may suffer from print artifacts such as a corduroy appearance attributed to hills and valleys caused by inconsistent ink drop line thicknesses and/or objectionable pile heights. Relying on a flood coat to achieve jetted gel ink line uniformity, and/or address varying line thickness and obviate objectionable print artifacts, can be costly and lead to a high gloss level that may be undesirable for some print jobs.

UV gel ink processes may benefit from methods, apparatus, and systems that cost-efficiently and effectively address objectionable pile heights and/or inconsistent ink line thicknesses by leveling gel ink after the ink is jetted directly onto a substrate, without otherwise degrading the printed image by, for example, offsetting gel ink onto the contact member, e.g., a leveling roll.

Systems in accordance with an embodiment may include a radiation curable gel ink printing system having a print head configured to deposit gel ink, such as ultra-violet ("UV") gel ink, directly onto a substrate such as a cut sheet or a media web. The substrate may be plastic, paper, coated paper, or other materials. Other suitable substrates may include, for example, foils. The gel ink may be deposited by any suitable radiation curable gel ink deposition methods and/or systems.

Systems include a UV curable ink leveling apparatus having a leveling nip defined by a contact member, e.g., a leveling roll, and a pressure member, e.g., a pressure roll. The contact member may be adapted to contact and/or apply pressure to the jetted UV gel ink on the substrate with minimal or no offset of ink to the contact member. The contact member may include a hydrophilic outer contact surface that contacts the ink on the substrate.

The pressure member may be a pressure roll. The pressure member includes a hydrophobic surface that accommodates application of low adhesion forces to back side of a substrate at the leveling nip and/or an opposing contact member. The substrate may be translated through the leveling nip from a print head in a process direction.

Apparatus and systems in accordance with an embodiment may include one or more UV sources for applying UV radiation to UV curable gel ink. The UV source may be adapted to cure the gel ink to a desired degree, or polymerize a desired amount of the gel ink. For example, the gel ink may be cured so that a small proportion of exposed ink is polymerized. In particular, the UV source may be configured to apply radiation to gel ink positioned on a substrate such that the gel ink thickens, thus allowing a contact member to contact the ink with minimal or no offsetting of the ink to the contact member.

Alternatively, the gel ink may be cured so that a substantial portion of exposed ink is polymerized. A UV source may be configured to cure the ink after the ink has been leveled at a leveling nip. For example, systems may include a first UV source for irradiating a gel ink image before the gel ink is leveled at a leveling nip, and a second UV sourced for irradiating the gel ink image after the gel ink is leveled to cure the gel ink image. Systems may be configured to deposit, level, and cure radiation curable inks using curing systems other than UV, such as e-beam systems.

Apparatus and systems may include a contact member having a contact surface that is hydrophilic, durable, and relatively inexpensive and easy to obtain. The contact member may be a rotatable roll having a hydrophilic ceramic surface or a hydrophilic elastomer. In an embodiment, the contact surface may comprise a plasma sprayed metal oxide coating that is ground and polished to produce a fine porous matrix. The contact surface of the contact member may comprise metal oxide such as chromium oxide, or preferably, titanium dioxide or titania.

The contact member forms a leveling nip with an opposing pressure member. The substrate may be may be translated through the leveling in a process direction. The pressure member may be a pressure roll that is rotatable about a central longitudinal axis. The pressure member includes a surface that is hydrophobic and durable. In an embodiment, the pressure member may include a surface comprising TEFLON or a fluorinated polymer.

Apparatus and system may include a sacrificial release layer fluid system for containing and/or adding water based release fluid to a surface of a contact member of a leveling nip. For example, the release fluid system may be configured to add water based release fluid to a surface of a contact member before gel ink image passes through the leveling nip in a print process. The hydrophobic surface of the pressure member minimizes an amount of release fluid that is attracted to the pressure member from the leveling member during leveling.

Methods of an embodiment may include contacting UV gel ink that is jetted directly onto a substrate such as a paper web with a contact member having a metal oxide surface, against a pressure member having a hydrophobic surface that contacts a back of the substrate during leveling at a leveling nip formed by the contact member and the pressure member.

Methods in accordance with an embodiment may include applying UV radiation to UV gel ink that has been jetted directly onto a surface of a substrate by an ink jet print head. In particular, a UV source may be adapted to cure the gel ink to alter a viscosity of the ink. Preferably, UV radiation may be applied to the jetted UV gel ink to thicken the ink before contacting the ink with a contact member for leveling, thereby minimizing or preventing offset of the ink to the contact member during the leveling process. In other embodiments, radiation curable gel ink may used, and any system configured to apply radiation that is effective for polymerizing an amount of ink may be used, including, for example, e-beam systems.

In another embodiment, methods include adding a water-based sacrificial release fluid to a contact surface of a contact member of a leveling apparatus before applying a metal oxide surface of the contact member to UV curable gel ink that has been jetted directly onto a substrate. For example, the contact member may comprise a plasma sprayed metal oxide ceramic surface that forms a fine porous matrix. For example, the contact member may comprise a metal oxide ceramic surface having a thickness of about 25 microns. The plasma sprayed metal oxide particle size may be about 5 microns or less. The sacrificial release layer may include water and surfactant and/or suitable polymers. The contact member and a hydrophobic pressure member define a leveling nip at which the contact member contacts the substrate.

Systems in accordance with another embodiment include a UV gel ink leveling apparatus for direct-to-substrate UV gel ink digital printing systems having a leveling nip formed by a contact member and a pressure member. The pressure member includes a surface that is hydrophobic. The contact member may include a metal oxide surface that facilitates retention of water, formation of a release fluid film, and accommodation of water based release fluids. A contact surface of the contact member may be formed by plasma spraying metal oxide onto a surface of the contact member, grounding the sprayed metal oxide particles, polishing the metal oxide on the contact surface to form a fine, porous metal oxide matrix.

The hydrophobic surface of the pressure member may be formed by applying a TEFLON layer, such as a TEFLON sleeve, to a pressure member having a silicone surface. Alternatively, the hydrophobic surface of the pressure member may be formed by spraying fluorinated polymer coating onto a urethane surface and curing the coating. The pressure member may be a rotatable roll, and may include a surface formed of a hydrophobic material such as a sprayed-on layer of TEFLON. In an alternative embodiment, the pressure member may be a pressure belt.

Exemplary embodiments are described herein. It is envisioned, however, that any systems that incorporate features of methods, apparatus, and systems described herein are encompassed by the scope and spirit of the exemplary embodiments.

DETAILED DESCRIPTION

Figure 1:
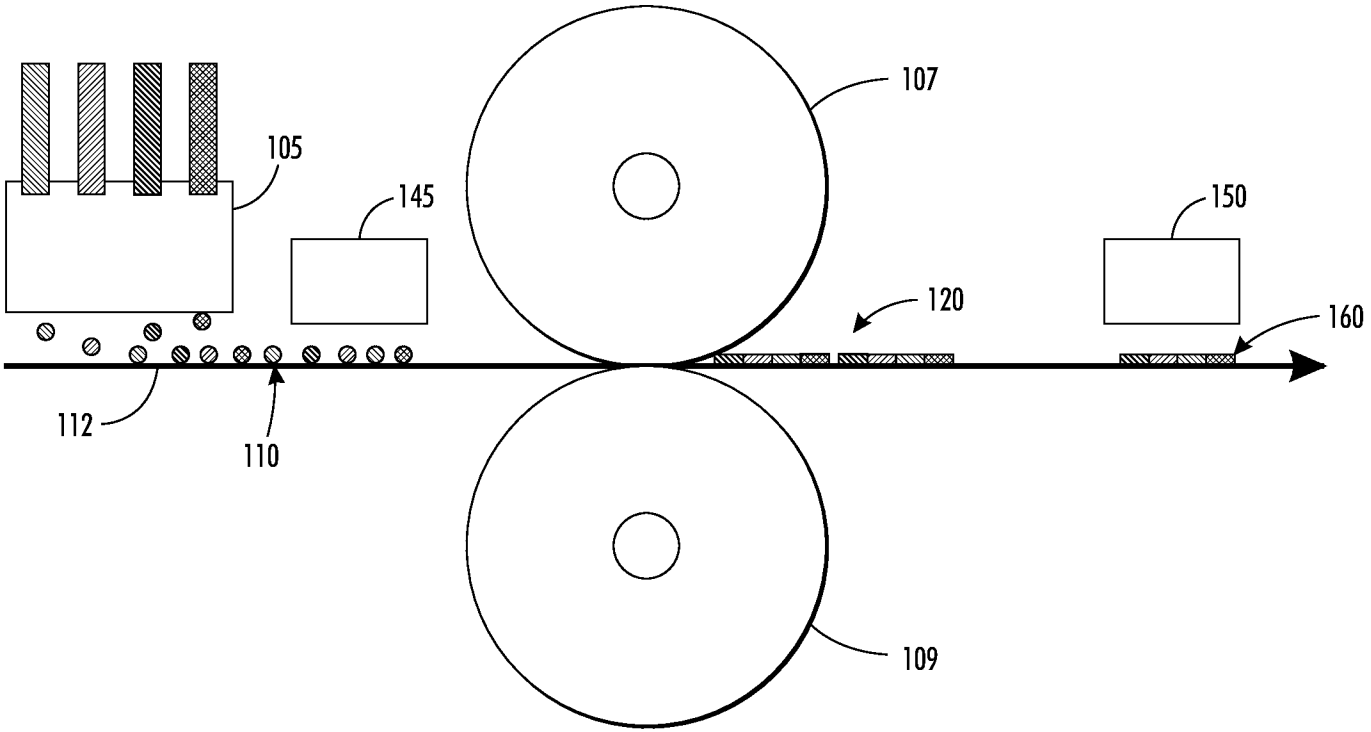
FIG. 1 shows a diagrammatical side view of a UV gel ink leveling apparatus and direct-to-substrate printing system in accordance with an exemplary embodiment.

Exemplary embodiments are intended to cover all alternatives, modifications, and equivalents as may be included within the spirit and scope of the methods, apparatus, and systems as described herein.

Reference is made to the drawings to accommodate understanding of methods, apparatus, and systems for radiation curable gel ink leveling. In the drawings, like reference numerals are used throughout to designate similar or identical elements. The drawings depict various embodiments and data related to embodiments of illustrative methods, apparatus, and systems for leveling UV gel ink that has been jetted directly onto a substrate such as a cut sheet or media web. The ink may be leveled at a leveling nip formed by a contact member that contacts the ink, and a pressure member that has a hydrophobic surface and that contacts a back side of the substrate.

FIG. 1 shows a radiation curable gel ink printing system and leveling apparatus in accordance with an exemplary embodiment. Specifically, FIG. 1 shows a UV gel ink printing system having a print head 105 for jetting UV gel ink. The print head 105 may be configured to contain and/or deposit or jet one or more inks, which may be black, clear, magenta, cyan, yellow or any other desired ink color.

The gel ink may be any radiation curable ink. For example, the gel ink may be curable by UV radiation. Further, the gel ink may be deposited by means other than an ink jet print head. The ink may be deposited directly onto the substrate by any suitable ink deposition means. For example, the ink may be jetted by ink jet print head 105 as shown in FIG. 1, or may be deposited by systems such as microelectromechanical systems configured to deposit gel ink onto a substrate, including gel ink that is heated to a liquid state.

The UV gel ink printing system may include a leveling apparatus having a leveling nip formed by a contact member 107 and a pressure member 109. The print head 105 may be configured, e.g., to jet or deposit UV gel ink directly onto a substrate to form an as-jetted image 110. For example, print head 105 may jet ink onto a substrate. The cut sheet may be a paper cut sheet, for example. Alternatively, the substrate may be a paper web such as web 112 as shown in FIG. 1.

After UV gel ink has been jetted onto the web 112, the web may be translated in a process direction to the leveling apparatus. As shown in FIG. 1, the contact member 107 may be a drum or roll that is rotatable about a central longitudinal axis. The contact member 107 may include a contact surface, which may be configured to contact jetted ink, e.g., jetted ink image 110, on an ink bearing surface of the substrate 112. In an alternative embodiment, the contact member may be a belt having a contact surface.

The contact member 107 may be associated with the pressure member 109 to define a leveling nip therewith for roll-on-roll leveling. The pressure member 109 includes a surface that is hydrophobic and exhibits low adhesion. The surface of the pressure member 109 is elastomeric and suitable for forming a nip with the contact member 107. For example, the pressure member may comprise a surface comprising a hydrophobic elastomer that is suitable for forming a nip with the contact member 107. The pressure member 109 may comprise a silicone layer over which a TEFLON sleeve is arranged. In another embodiment, the pressure member may include a urethane layer that is coated with a fluorinated polymer. The fluorinated polymer may be sprayed onto the urethane layer and cured to form a hydrophobic coating. The surface of the pressure member may comprise sprayed-on TEFLON. The pressure member 109 may be a rotatable roll as shown. In an alternative embodiment, the pressure member may be a belt such as an endless belt.

The web 112 may be configured to carry the jetted ink image 110 through the nip to level the gel ink of the ink image 110. The contact member 107 levels the ink of the jetted ink image 110 by applying pressure to the ink on the substrate to produce a leveled ink image 120.

In an embodiment, the leveling nip may be associated with a radiation source such as a UV source. As shown in FIG. 1, the UV gel ink printing system may include a UV source 145. The UV source 145 may be arranged to apply UV radiation to ink of the jetted ink image 110 before the ink is leveled by the contact member 107 and the pressure member 109 of the leveling nip.

The UV source 145 may be configured to cure the ink such that an amount of the ink polymerizes. For example, a small of amount of ink comprising the ink image 110 may be polymerized. Alternatively, a substantial amount of the ink may be polymerized. For example, a UV source positioned downstream of the leveling nip may be adapted to irradiate UV curable gel ink of a gel ink image to produce a final cure.

Preferably, the UV source 145 may be configured to apply UV radiation to the gel ink of the ink image 110 to polymerize enough of the gel ink to increase a viscosity of the ink before the ink is contacted by the contact member 107. For example, the viscosity of the ink may be altered, e.g. increased to minimize or eliminate offset of the UV curable gel ink to the contact member 107 during leveling and/or contact of the ink by the contact member 107 at the leveling nip. The amount of cure required to minimize or prevent offset may depend on ink properties, including, for example, amount of gel, monomer composition, and an amount of photoinitiator present. Further, an amount of cure to apply may depend on radiation wavelength and interaction with the photoinitiator, and exposure, including a combination of wavelength, intensity, and time.

In an embodiment, the UV source 145 may be a first UV source, and a UV curable gel ink digital printing system may include a second UV source 150. The second UV source 150 may be configured to apply UV radiation after the ink of the image 110 is leveled by the contact member 107 to produce the leveled ink image 120. As shown in FIG. 1, the UV source 150 may be used to irradiate the leveled ink image 120 to produce a final cured ink image 160. In other embodiments, a radiation source may be configured to irradiate and cure radiation curable inks by means other than UV radiation. For example, e-beam systems may be used.

The contact member 107 may be a leveling roll that is configured to apply pressure to ink of the jetted ink image 110 to produce a leveled ink image 120. For example, the contact member 107 may be a leveling roll configured to rotate about a central longitudinal axis. The contact member 107 may include a hydrophilic contact surface that contacts the ink of the jetted ink image 110. Before the contact member 107 contacts the ink, a viscosity of the ink may be altered by the UV source 145. For example, the ink may be thickened to, e.g., minimize or prevent offset of the ink to the contact member 107 during leveling. The ink may be thickened as desired by applying an amount of cure required to minimize or prevent offset. The amount of cure applied may depend on ink properties, including, for example, amount of gel, monomer composition, and an amount of photoinitiator present. Further, an amount of cure to apply may depend on radiation wavelength and interaction with the photoinitiator, and exposure, including a combination of wavelength, intensity, and time.

The contact surface of the contact member 107 may be a hydrophilic surface that is durable and relatively inexpensive to produce. The surface material is suitable for forming a nip with an opposing member. The contact member 107 is configured with hydrophobic pressure member 109 to form a leveling nip. The contact member 107 may be a roll having a ceramic surface that contacts the opposing hydrophobic pressure member, e.g., a roll having an elastomeric surface, to form a nip. For example, the contact surface of the contact member 107 may comprise metal oxide. In an embodiment, the contact member 107 may comprise titanium dioxide or titania. In another embodiment, the contact surface of the contact member 107 may comprise chromium oxide. A hydrophilic contact surface comprising metal oxides such as chromium oxide, and preferably, titanium dioxide may accommodate absorption of water-based release fluids, which further accommodates effective leveling of the UV gel ink by minimizing or preventing offset of gel ink from the substrate 112 to the contact member 107.

The hydrophilic metal oxide particles may be arranged on the surface of the contact member 107 to form a porous structure that retains water by capillary function. For example, the contact surface may be formed by plasma spraying hydrophilic metal oxide particles such as titanium dioxide on a contact member such as a roll, and grounding and polishing the particles to produce a fine matrix with pores that act as capillary media for a water-based fountain solution. For example, the contact member may comprise a metal oxide ceramic surface having a thickness of about 25 microns. The plasma sprayed metal oxide particle size may be about 5 microns or less. While the surface energy of the individual metal oxide particles may be higher than the surface energy for substances such as Teflon, a metal oxide-containing contact surface accommodates improved offset performance, or resistance to offset for a particular ink viscosity, by aiding in retention and filming of water based release fluids for gel ink leveling.

Release fluid may be added to a surface of the contact member 107 before the contact surface contacts a jetted ink image 110 for leveling. For example, a sacrificial release layer fluid may be contained and/or deposited onto a contact member 107 by a leveling apparatus release fluid system (not shown). The release fluid system may be configured to contain and/or deposit release fluid onto a surface of the contact member 107. Exemplary release fluids that may be effectively used with, e.g., a titanium dioxide ceramic surface include sodium dodecyl sulfate (SDS) based fountain solutions, and preferably polymer based fountain solution such as SIL- GAURD. Release fluids may include water-soluble short chain silicones, water with surfactants, defoamers, and other fluids suitable for forming a sacrificial release layer.

The elastomeric, hydrophobic surface of a pressure member 109 enables the pressure member 109 to form an operable leveling nip with a contact member 107. Further, the hydrophobic surface of the pressure member 109 may minimize and/or prevent undesirable release fluid consumption and/or non-uniform application of release fluid to the contact member 107. In apparatus and systems in which a water based release fluid is added to a surface of a contact member 107 before leveling to form a sacrificial release layer, the hydrophobic surface of the pressure member 109 minimizes or prevents an amount of release fluid from migrating from the contact member 107 to the pressure member 109.

In cut sheet printing systems, the hydrophobic surface of the pressure member 109 minimizes or prevents a water based released fluid from migrating to a contact member 107 to a pressure member 109 at, e.g., inter document zones where the two members contact one another with no interposing substrate. In web systems, the contact member 107 and the pressure member 109 may contact one another outside of the web path. A hydrophobic surface of the pressure member 109 having a low surface energy that accommodates low adhesion minimizes or prevents undesirable interference with the sacrificial release layer formed by the release fluid on a surface of the contact member 107.

The low surface energy of the hydrophobic surface of the pressure member 109 further accommodates a low adhesion between a back of the substrate 112 and the surface of the pressure member 109. Accordingly, the hydrophobic surface of the pressure member 109 enables improved stripping in cut sheet applications and reduced chatter in web applications.

Figure 2:
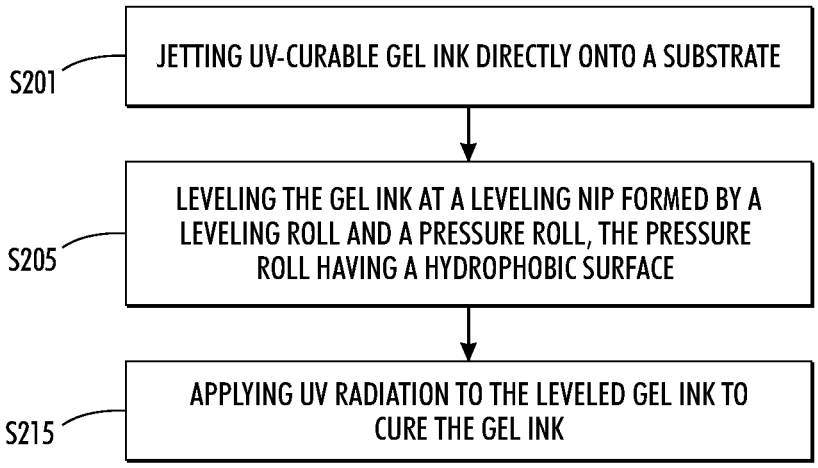
FIG. 2 shows a UV gel ink leveling and curing process in accordance with an exemplary embodiment.

FIG. 2 shows an embodiment of methods for leveling radiation curable gel ink such as UV-curable gel ink in a direct-to-substrate digital printing process. Methods may include depositing UV-curable gel ink directly onto a substrate at S201. Specifically, the UV curable gel ink may be jetted by an ink jet print head. The substrate may be a cut sheet. Alternatively, the substrate may be a media web such as a paper web.

Methods the embodiment shown in FIG. 2 include leveling the gel ink at a leveling nip at S205. The leveling nip may be formed by a leveling member and a pressure member having a hydrophobic surface. For example, the leveling member may be a leveling roll having a hydrophilic ceramic surface, and the pressure member may be a pressure roll having an elastomeric surface suitable for forming a nip. The leveling roll and the pressure roll may be configured to form a nip for roll-on-roll leveling.

A surface of the contact member or leveling member may be a hydrophilic metal oxide surface. The contact member may be configured to retain water, and to form a water based fluid release film on a surface thereof when release fluid is added to the contact surface by a release fluid system for leveling. The metal oxide surface may be formed by plasma spraying a surface of a contact member with metal oxide, and grounding and polishing the metal oxide to produce a fine porous matrix.

A surface of the pressure member is hydrophobic, and may be configured to exhibit low adhesion. The hydrophobic surface may minimize or prevent migration of water based release fluid to the pressure member during the print process. For example, a water based release fluid forming a film on a contact member may be prevented from migrating to a hydrophobic pressure member at an inter document zone of a UV curable gel ink digital direct-to-substrate printing system configured for cut sheet printing and processing. Low adhesion of the hydrophobic surface of the pressure member is also advantageous for web printing systems wherein end portions of the pressure member and contact member are not interposed by the media web, e.g., outside of the substrate path. Further, a hydrophobic surface of a pressure member, which may have a low surface energy and thus exhibits low adhesion, accommodates improved pressure roll stripping for cut sheet systems, and decreased web chatter in web applications, e.g., a reduction in deleterious effects resulting from variation in surface adhesion among non-ink and ink areas in low lineal poundage applications.

The leveling nip may be arranged downstream, in a process direction, from the print head, and the substrate may be translated to carry gel ink jetted by the print head to the leveling nip of the leveling apparatus. After the ink is leveled at S205, the ink may be irradiated with UV radiation by a UV source at S215. The UV source may be configured to apply radiation to the ink to polymerize the ink and/or cure the ink of the ink image to produce a final cured image. In an alternative embodiment, radiation curable gel ink may be irradiated with radiation sources other than UV sources, and may be irradiate by systems such as e-beam systems.

Figure 3:
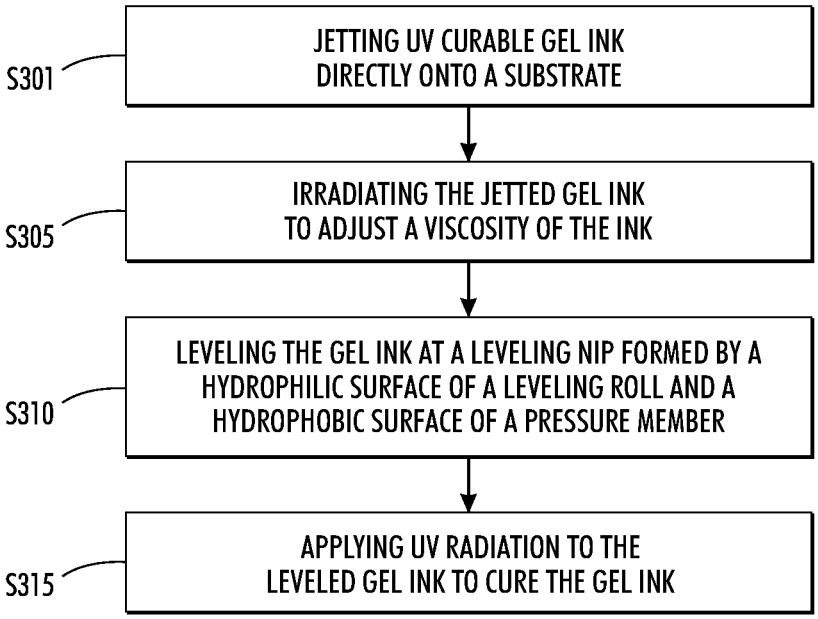
FIG. 3 shows a UV gel ink leveling and curing process in accordance with an exemplary embodiment.

FIG. 3 shows another embodiment of methods for leveling radiation curable ink such as UV curable gel ink in a direct-to-substrate digital printing process. As shown in FIG. 3, methods may include depositing, e.g., jetting UV curable gel ink directly onto a substrate at S301. The UV gel ink may be jetted from an ink jet print head configured to deposit and/or jet gel ink. The substrate may be a cut sheet or a media web, such as a paper web. At S305, a UV source may apply radiation to the UV curable gel ink jetted onto the substrate. The radiation may be applied to increase a viscosity of the ink. Specifically, the ink may be thickened at S305 to minimize or prevent jetted gel ink from adhering to a contact member at a leveling nip.

In methods according to an embodiment as shown in FIG. 3, the thickened ink and substrate may be advanced to a leveling nip for leveling the ink at S310. The nip may be defined by a contact member, such as a leveling roll, and an opposing member, e.g., a pressure roll. The contact roll includes a metal oxide surface for contacting the UV curable gel ink jetted on the substrate at S301 and thickened at S305 to level the ink at S310. The metal oxide contact surface may include chromium oxide. Preferably, the contact surface may include titanium dioxide. The metal oxide surface may be formed by plasma spray, grounding, and polishing metal oxides on a surface of a contact member to produce a porous fine metal oxide matrix.

A surface of the pressure member is hydrophobic. For example, the surface may comprise a hydrophobic elastomer. In an embodiment, the ink may be leveled at a nip formed by a pressure member having a surface comprising silicone, and a Teflon layer arranged over the silicon. In another embodiment, the ink may be leveled by a pressure member such as a pressure roll having a urethane surface that has been sprayed with a hydrophobic coating such as a fluorinated polymer. Other suitable coating materials may include, for example, PFA, TEFZEL, SICLEAN, impregnated urethane.

The leveled ink may be advanced to a UV source for curing the gel ink at S315. For example, radiation may be applied by a UV source at S315 to a leveled ink image on a substrate to produce a final cured UV curable gel ink image.

Figure 4:
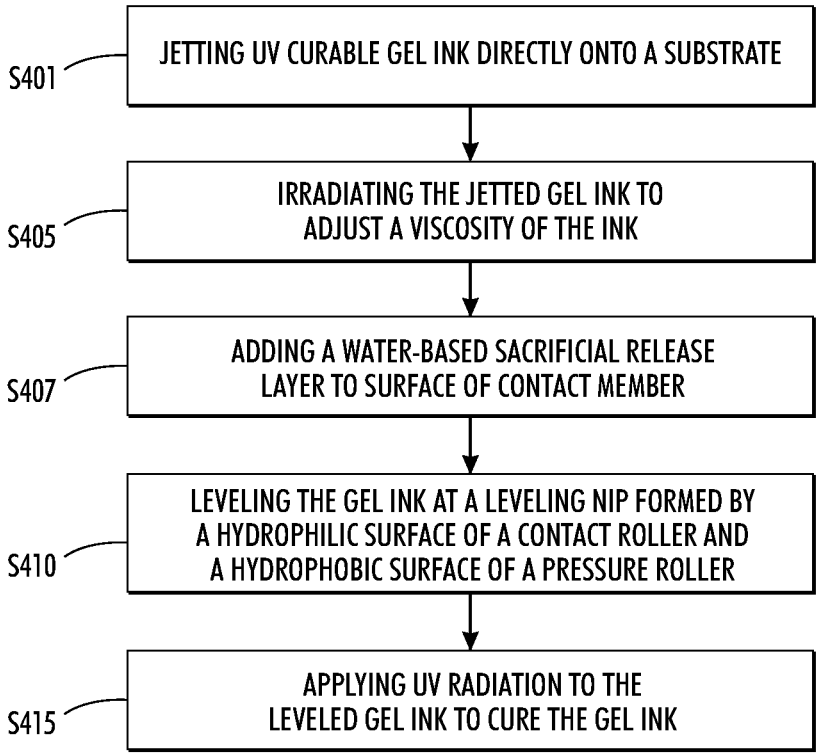
FIG. 4 shows a UV gel ink leveling and curing process in accordance with an exemplary embodiment.

FIG. 4 shows another embodiment of methods for leveling radiation curable ink such as UV curable gel ink in a direct-to-substrate digital printing process. As shown in FIG. 4, methods may include depositing, e.g., jetting UV-curable gel ink directly onto a substrate at S401. The substrate may be a media web, such as a paper web. Alternatively, the substrate may be a cut sheet. At S405, a UV source may apply radiation to the UV curable gel ink jetted onto the substrate. The radiation may adjust a viscosity of the ink. Specifically, the viscosity of the ink may be increased at S405.

The thickened ink and substrate may be advanced to a leveling nip for leveling. The nip may be defined by a contact member, such as a leveling roll, and an opposing member, e.g., a pressure roll. The contact roll includes a hydrophilic metal oxide surface for contacting the UV curable gel ink jetted on the substrate at S401 and thickened at S405. The metal oxide contact surface may include chromium oxide. Preferably, the contact surface may include titanium dioxide or titania. The metal oxide surface may be formed by plasma spray, grounding, and polishing metal oxides on a surface of a contact member to produce a porous fine metal oxide matrix that retains water and facilitates formation of a water based release fluid film on a surface of the contact member.

Release fluids may be added to the surface of the contact member at S407. The release fluids may be water based fluids. An exemplary release fluid may be SDS, or preferably polymer containing release fluids such as SILGAURD. Other suitable release fluids may include, for example, a glycol based fluid in water, surfactant in water, and alcohol solutions. Release fluid for forming a sacrificial release layer on a contact surface of a contact member may be contained and/or deposited onto the contact surface by a release fluid system.

A surface of the pressure member, e.g., pressure roll is hydrophobic. For example, the surface may comprise a hydrophobic elastomer. In an embodiment, the ink may be leveled at a nip formed by a pressure member having a surface comprising silicone, and a Teflon layer arranged over the silicone. In another embodiment, the ink may be leveled by a pressure member such as a pressure roll having a urethane surface that has been sprayed with a hydrophobic coating such as a fluorinated polymer. In another embodiment, a pressure member such as a roll may be sprayed with TEFLON.

At S410, the contact member having the added sacrificial release fluid on its surface may contact the ink jetted onto the substrate and thickened by the UV source to level the ink. The leveled ink may be advanced to another UV source for curing the gel ink. For example, radiation may be applied to a leveled ink image on a substrate to produce a final cured UV curable gel ink image.

While methods, apparatus, and systems for radiation gel ink leveling at a leveling nip having a hydrophobic pressure member in direct-to-substrate printing operations are described in relationship to exemplary embodiments, many alternatives, modifications, and variations would be apparent to those skilled in the art. Accordingly, embodiments of methods, apparatus, and systems as set forth herein are intended to be illustrative, not limiting. There are changes that may be made without departing from the spirit and scope of the exemplary embodiments.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art.

What is claimed is:

1. A radiation curable gel ink leveling method, comprising: directly contacting a radiation curable gel ink on a first side of a substrate with a contact member at a leveling nip, the leveling nip being formed by the contact member and a pressure member, the pressure member having a hydrophobic surface, the pressure member being configured to face and to contact a second side of the substrate;

separating the contact member from the ink and the substrate;

jetting the gel ink directly from an ink jet print head onto the substrate to form a radiation curable gel ink image; and irradiating the gel ink to thicken the ink before contacting the gel ink with the contact member, wherein the contact member is hydrophilic and comprises a porous metal oxide matrix, and the surface of the pressure member comprises one of a TEFLON layer arranged over a silicone surface whereby the TEFLON surface interposes the silicone surface and the contact member at the nip and a urethane layer coated with a fluorinated polymer.

2. The method of claim 1, further comprising:

irradiating the gel ink after contacting the gel ink with the contact member to cure the gel ink.

3. The method of claim 1, further comprising:

adding a water based sacrificial release fluid to a surface of the contact member before contacting the gel ink with the contact member, the water based release fluid comprising at least one of a surfactant and a polymer.

4. The method of claim 1, wherein the metal oxide comprises a material selected from the group comprising chromium oxide, titanium dioxide, and titania.

5. A radiation curable gel ink leveling apparatus, comprising:

a pressure member, the pressure member having a hydrophobic surface;

a contact member, the contact member and the pressure member forming a nip, wherein the surface of the pressure member comprises one of an elastomer, the contact member further comprising a hydrophilic metal oxide surface, a silicone layer and a TEFLON layer arranged over the silicone layer, the TEFLON layer being an outermost layer of the pressure member, and a urethane layer, the urethane layer being spray-coated with a fluorinated polymer; and a radiation source, the radiation source being configured to irradiate the radiation curable gel ink before the gel ink is contacted by the contact member at the nip.

6. The apparatus of claim 5, the radiation source being a first UV source, the apparatus further comprising:

the first UV source being configured to irradiate the gel ink to increase a viscosity before the contact member contacts the gel ink on the substrate in a print process; and a second UV source, the second UV source being configured to cure the gel ink after the contact member contacts the gel ink on the substrate in a print process.

7. The apparatus of claim 5, further comprising:

a water based sacrificial release fluid system that forms a sacrificial fluid layer on a surface of the contact member, the surface of the contact member being hydrophilic and comprising a metal oxide.

8. The apparatus of claim 5, further comprising:

an ink jet print head, the print head being configured to jet the gel ink directly onto the substrate.

9. The apparatus of claim 5, wherein the metal oxide comprises a material selected from the group comprising chromium oxide, titanium dioxide, and titania.

10. A radiation curable gel ink direct-to-substrate digital printing system, comprising:

an ink jet print head configured to jet radiation curable gel ink directly onto a substrate to form a gel ink image on a first side of the substrate;

a leveling apparatus that levels the gel ink, the leveling apparatus comprising a leveling nip, the leveling nip being formed by a contact member and a pressure member, the contact member being configured to directly contact the gel ink on the substrate until the substrate exits the leveling nip, the contact member comprising a hydrophilic contact surface, the contact surface comprising metal oxide, and the pressure member comprising a hydrophobic surface and an elastomer, wherein the pressure member contacts a second side of the substrate;

a sacrificial release fluid system configured to deposit a water based release fluid onto the hydrophilic contact surface before the contact surface contacts the gel ink at the leveling nip and a radiation source configured to applying radiation to the gel ink before the contact member contacts the gel ink to thicken the ink.

11. The system of claim 10, further comprising:

a radiation source configured to cure the gel ink after the contact member contacts the gel ink.

12. The system of claim 10, wherein the metal oxide comprises a material selected from the group comprising chromium oxide, titanium dioxide, and titania.

* * * * *